US010767571B2

(12) United States Patent
Glugla et al.

(10) Patent No.: US 10,767,571 B2
(45) Date of Patent: Sep. 8, 2020

(54) METHODS AND SYSTEM FOR OPERATING AN ENGINE

(71) Applicant: Ford Global Technologies, LLC, Dearborn, MI (US)

(72) Inventors: Christopher Paul Glugla, Macomb, MI (US); Imtiaz Ali, Lathrup Village, MI (US); Lyth Alobiedat, Detroit, MI (US); Timothy Joseph Clark, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 237 days.

(21) Appl. No.: 16/039,181

(22) Filed: Jul. 18, 2018

(65) Prior Publication Data

US 2020/0025113 A1 Jan. 23, 2020

(51) Int. Cl.
*F02D 15/02* (2006.01)
*F02B 75/04* (2006.01)

(52) U.S. Cl.
CPC ..... *F02D 15/02* (2013.01); *F02D 2200/101* (2013.01); *F02D 2200/602* (2013.01); *F02D 2700/03* (2013.01)

(58) Field of Classification Search
CPC ..... F02D 15/00; F02D 15/02; F02B 75/04; F02B 75/045; F01B 31/14
See application file for complete search history.

(56) References Cited

U.S. PATENT DOCUMENTS

| | | | | |
|---|---|---|---|---|
| 4,535,730 | A * | 8/1985 | Allen | F02B 75/048 123/48 B |
| 6,561,145 | B1 | 5/2003 | Stockhausen et al. | |
| 6,938,593 | B2 | 9/2005 | Magner et al. | |
| 7,802,544 | B2 | 9/2010 | Kamada | |
| 7,934,475 | B2 | 5/2011 | Meintschel et al. | |
| 8,209,104 | B2 * | 6/2012 | Soejima | F02D 37/02 123/406.23 |
| 9,062,613 | B1 * | 6/2015 | Shen | F02D 15/02 |
| 2009/0036267 | A1 | 2/2009 | Bellinger | |

(Continued)

FOREIGN PATENT DOCUMENTS

| | | | |
|---|---|---|---|
| DE | 102011017202 | A1 | 10/2012 |
| JP | 2002317663 | A | 10/2002 |

(Continued)

OTHER PUBLICATIONS

Uhrich, M. et al., "Systems and Methods for Particulate Filter Regeneration," U.S. Appl. No. 15/653,237, filed Jul. 18, 2017, 51 pages.

(Continued)

*Primary Examiner* — Grant Moubry
(74) *Attorney, Agent, or Firm* — Geoffrey Brumbaugh; McCoy Russell LLP

(57) ABSTRACT

Systems and methods for operating an engine that includes a compression ratio linkage for adjusting engine compression ratio are described. The systems and methods provide different ways of changing a compression ratio of an engine based on forecast or anticipated engine operating conditions. In one example, the forecast or anticipated engine operating conditions may include a forecast or anticipated transmission gear shift.

20 Claims, 10 Drawing Sheets

(56) References Cited

U.S. PATENT DOCUMENTS

2010/0030447 A1* 2/2010 Smyth ..... B60W 20/20
701/102

FOREIGN PATENT DOCUMENTS

JP 2009085187 A 4/2009
JP 2010151088 A 7/2010

OTHER PUBLICATIONS

Glugla, C. et al., "Method and System for Diagnosing Operation of an Engine Compression Ratio Changing Mechanism," U.S. Appl. No. 15/838,220, filed Dec. 11, 2017, 45 pages.
Gadau, F. et al., "System and Method for Variable Compression Ratio Engine," U.S. Appl. No. 16/019,293, filed Jun. 26, 2018, 76 pages.

* cited by examiner

METHODS AND SYSTEM FOR OPERATING AN ENGINE

FIELD

The present description relates to methods and a system for operating an internal combustion engine. The methods and systems may be particularly useful for reducing the possibility of engine knock.

BACKGROUND AND SUMMARY

An engine may include an actuator for changing the engine's compression ratio. By changing the engine's compression ratio, it may be possible to improve engine efficiency. In one example, a lower compression ratio may be provided in the engine at higher engine speeds and loads to reduce the possibility of engine knock. A higher compression ratio may be provided in the same engine at lower engine loads to increase engine efficiency when the possibility of engine knock is lower. The compression ratio may be set to an intermediate value that is between the high compression ratio and the low compression ratio when the engine is operated at intermediate load levels. However, even with variable compression, the engine may knock during some conditions. Therefore, it may be desirable to provide a way of reducing a possibility of engine knock for a variable compression ratio engine that includes an actuator to adjust the engine's compression ratio.

The inventors herein have recognized the above-mentioned issues and have developed an engine operating method, comprising: adjusting an engine's compression ratio via a controller responsive to present engine speed and engine load; forecasting a shifting of a transmission from a first gear to a second gear via the controller; and adjusting an engine's compression ratio via the controller responsive to an engine speed and engine load based on the forecasted shifting of the transmission.

By forecasting or predicting when a transmission shift is expected to occur, it may be possible to provide the technical result of reducing the possibility of engine knock that may be related to engine load changing as a result of a transmission gear shift. Specifically, the engine's compression ratio (CR) may be decreased before the transmission is upshifted so that the engine is at a lower compression ratio when the transmission gear shift completes so that an increase in engine load that results from the transmission gear shift may not cause engine knock. Conversely, the engine's compression ratio may be maintained at a lower level until a transmission gear shift is completed when the transmission is downshifted since the engine may operate with the lower compression ratio for a short period of time without engine efficiency degrading substantially.

The present description may provide several advantages. Specifically, the approach may provide improved engine knock control before and after transmission gear shifts. In addition, the approach forecasts or predicts transmission gear shifting events so that a compression ratio device may be operated to improve engine efficiency and mitigate engine knock. Further, the approach may reduce a possibility of driveline torque disturbances that may be caused by operating a compression ratio changing device while a transmission is shifting between fixed gear ratios.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 2:
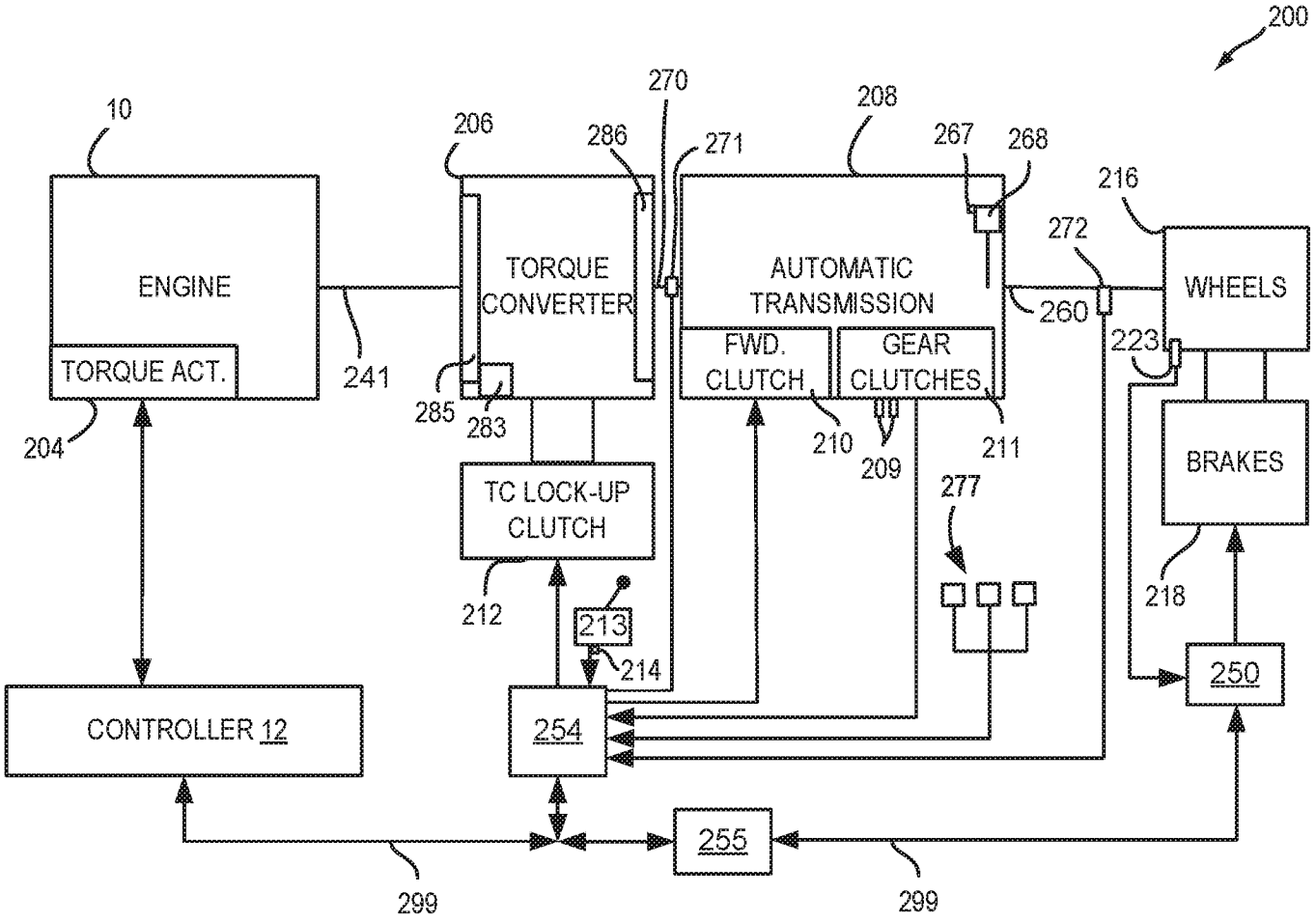
FIG. 2 is a schematic diagram of a driveline that includes the engine of FIG. 1.
Figure 3B:
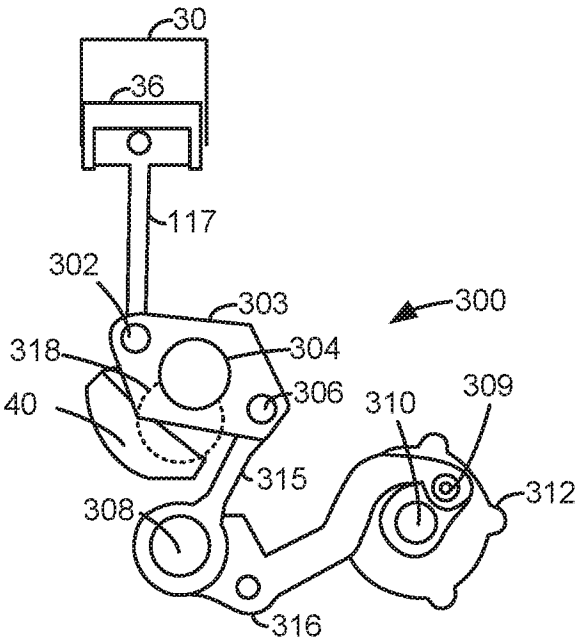
FIGS. 3A and 3B show an engine compression ratio changing linkage in two positions.
Figure 3A:
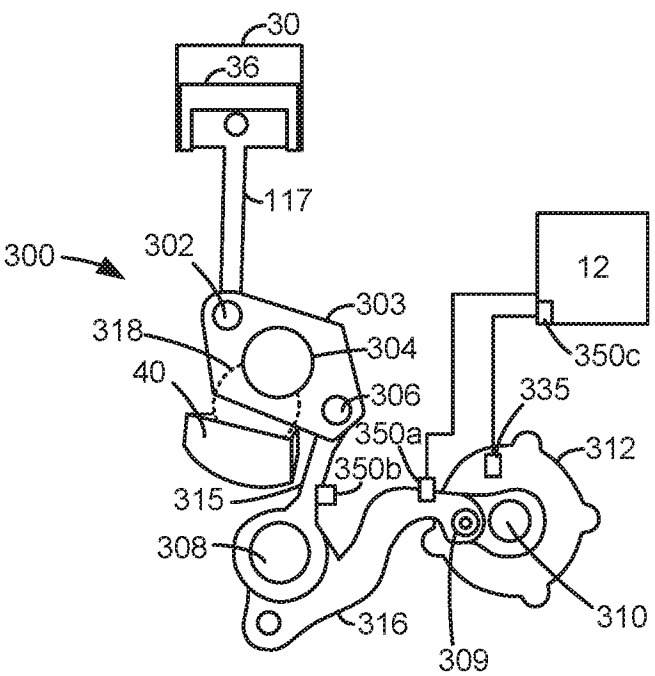
Figure 4:
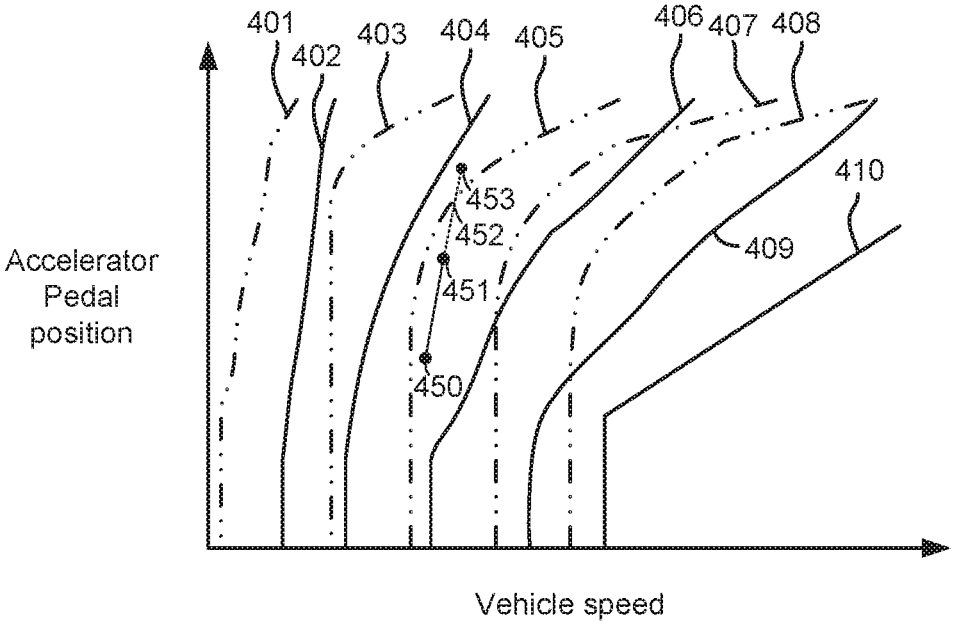
FIG. 4 shows a plot of an example transmission shift schedule.

The present description is related to operating a variable compression ratio engine and changing a compression ratio of an engine to reduce a possibility of engine knock and to reduce the possibility of driveline torque disturbances. The engine may be of the type shown in FIG. 1 or it may be a diesel engine. The engine may be incorporated into a driveline with a transmission as shown in FIG. 2. The engine may include one or more cylinder compression ratio changing linkages as shown in FIGS. 3A and 3B. The transmission may be shifted according to a shift schedule as shown in FIG. 4. The engine's compression ratio may be changed as indicated in the compression ratio map of FIG. 5. The engine may be operated according to the method of FIGS. 7-11 to provide the operating sequence shown in FIG. 6.

Figure 1:
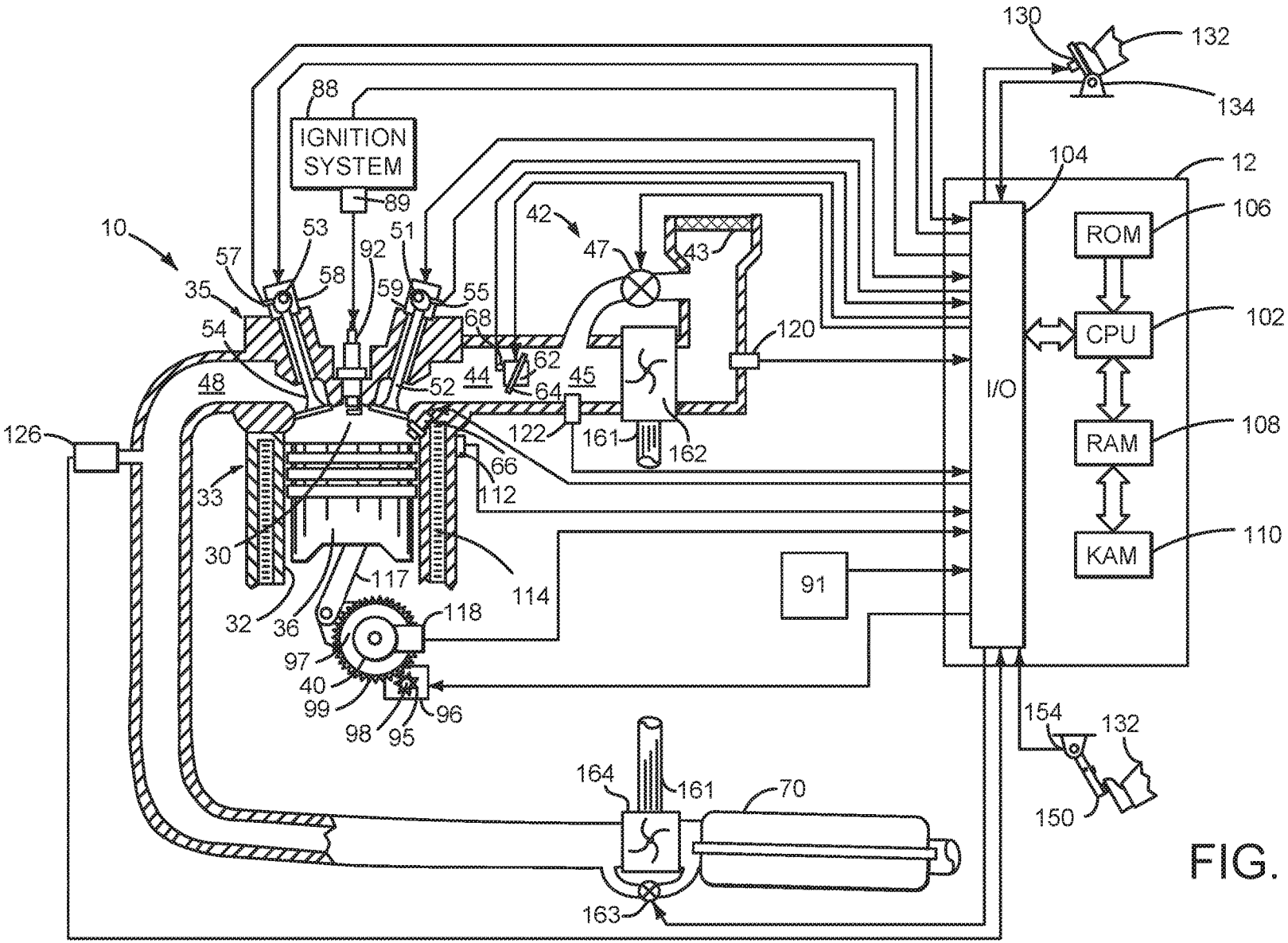
FIG. 1 is a schematic diagram of an engine.

Referring to FIG. 1, internal combustion engine 10, comprising a plurality of cylinders, one cylinder of which is shown in FIG. 1, is controlled by electronic engine controller 12. The controller 12 receives signals from the various sensors shown in FIGS. 1-3B and employs the actuators shown in FIGS. 1-3B to adjust engine and powertrain or driveline operation based on the received signals and instructions stored in memory of controller 12.

Engine 10 is comprised of cylinder head 35 and block 33, which include combustion chamber 30 and cylinder walls 32. Piston 36 is positioned therein and it reciprocates with rod 117 via a connection to crankshaft 40. Flywheel 97 and ring gear 99 are coupled to crankshaft 40. Starter 96 (e.g., low voltage (operated with less than 30 volts) electric machine) includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply torque to crankshaft 40 via a belt or chain. In one example, starter 96 is in a base state when it is not engaged to the engine crankshaft 40.

Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57. Intake valve 52 may be selectively activated and deactivated by valve activation device 59. Exhaust valve 54 may be selectively activated and deactivated by valve activation device 58. Valve activation devices 58 and 59 may be electromechanical devices.

Fuel injector 66 is shown positioned to inject fuel directly into cylinder 30, which is known to those skilled in the art as direct injection. Fuel injector 66 delivers liquid fuel in proportion to the pulse width from controller 12. Fuel is delivered to fuel injector 66 by a fuel system (not shown) including a fuel tank, fuel pump, and fuel rail (not shown). In one example, a high pressure, dual stage, fuel system may be used to generate higher fuel pressures.

In addition, intake manifold 44 is shown communicating with turbocharger compressor 162 and engine air intake 42. In other examples, compressor 162 may be a supercharger compressor. Shaft 161 mechanically couples turbocharger turbine 164 to turbocharger compressor 162. Optional electronic throttle 62 adjusts a position of throttle plate 64 to control air flow from compressor 162 to intake manifold 44. Pressure in boost chamber 45 may be referred to a throttle inlet pressure since the inlet of throttle 62 is within boost chamber 45. The throttle outlet is in intake manifold 44. In some examples, throttle 62 and throttle plate 64 may be positioned between intake valve 52 and intake manifold 44 such that throttle 62 is a port throttle. Compressor recirculation valve 47 may be selectively adjusted to a plurality of positions between fully open and fully closed. Waste gate 163 may be adjusted via controller 12 to allow exhaust gases to selectively bypass turbine 164 to control the speed of compressor 162. Air filter 43 cleans air entering engine air intake 42.

Distributorless ignition system 88 provides an ignition spark to combustion chamber 30 via ignition coil 89 and spark plug 92 in response to controller 12 spark timing signals. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Engine torque may be adjusted via adjusting spark timing, fuel amount supplied via the fuel injectors, fuel timing, throttle plate position, intake and exhaust valve timing, boost pressure, spark energy, and the amount of air supplied to the engine. Thus, engine torque may be adjusted via adjusting operation of actuators such as ignition coil 89, a position of throttle 62, a position of waste gate 163, a position of compressor recirculation valve 47, intake valve activation device 59, and exhaust valve activation device 58.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by human foot 132; a position sensor 154 coupled to brake pedal 150 for sensing force applied by human foot 132, a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 68. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined. Further, controller 12 may communicate with human/machine interface 91 to indicate status of diagnostics and provide feedback to vehicle occupants.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC).

During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion.

During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

FIG. 2 is a block diagram of a vehicle 225 including a powertrain or driveline 200. The powertrain of FIG. 2 includes engine 10 shown in FIG. 1. Powertrain 200 is shown including vehicle system controller 255, engine controller 12, transmission controller 254, and brake controller 250. The controllers may communicate over controller area network (CAN) 299. Each of the controllers may provide information to other controllers such as torque output limits (e.g., torque output of the device or component being controlled not to be exceeded), torque input limits (e.g., torque input of the device or component being controlled not to be exceeded), torque output of the device being controlled, sensor and actuator data, diagnostic information (e.g., information regarding a degraded transmission, information regarding a degraded engine, information regarding degraded brakes). Further, the vehicle system controller 255 may provide commands to engine controller 12, transmission controller 254, and brake controller 250 to achieve driver input requests and other requests that are based on vehicle operating conditions.

For example, in response to a driver releasing an accelerator pedal and vehicle speed, vehicle system controller 255 may request a desired wheel torque or a wheel power level to provide a desired rate of vehicle deceleration. The desired wheel torque may be provided by vehicle system controller 255 requesting a braking torque from brake controller 250.

In other examples, the partitioning of controlling powertrain devices may be partitioned differently than is shown in FIG. 2. For example, a single controller may take the place of vehicle system controller 255, engine controller 12, transmission controller 254, and brake controller 250. Alternatively, the vehicle system controller 255 and the engine controller 12 may be a single unit while the transmission controller 254 and the brake controller 250 are standalone controllers.

In this example, powertrain 200 may be powered by engine 10. Engine 10 may be started with an engine starting system shown in FIG. 1. Further, torque of engine 10 may be adjusted via torque actuator 204, such as a fuel injector, throttle, etc.

An engine output torque may be transmitted to torque converter 206. Torque converter 206 includes a turbine 286 to output torque to input shaft 270. Transmission input shaft 270 mechanically couples torque converter 206 to automatic transmission 208. Torque converter 206 also includes a torque converter bypass lock-up clutch 212 (TCC). Torque is directly transferred from impeller 285 to turbine 286 when TCC is locked. TCC is electrically operated by controller 254. Alternatively, TCC may be hydraulically locked. In one example, the torque converter may be referred to as a component of the transmission.

When torque converter lock-up clutch 212 is fully disengaged, torque converter 206 transmits engine torque to automatic transmission 208 via fluid transfer between the torque converter turbine 286 and torque converter impeller 285, thereby enabling torque multiplication. In contrast, when torque converter lock-up clutch 212 is fully engaged, the engine output torque is directly transferred via the torque converter clutch to an input shaft 270 of automatic transmission 208. Alternatively, the torque converter lock-up clutch 212 may be partially engaged, thereby enabling the amount of torque that is relayed to the transmission to be adjusted. The transmission controller 254 may be configured to adjust the amount of torque transmitted by torque converter 212 by adjusting the torque converter lock-up clutch in response to various engine operating conditions, or based on a driver-based engine operation request. Torque converter 206 also includes mechanically driven pump 283 that pressurizes fluid to operate gear clutches 211. Pump 283 is driven via impeller 285, which rotates at a same speed as engine 10.

Automatic transmission 208 includes gear clutches (e.g., gears 1-10) 211 and forward clutch 210. Automatic transmission 208 is a fixed step ratio transmission. The gear clutches 211 and the forward clutch 210 may be selectively engaged to change a ratio of an actual total number of turns of input shaft 270 to an actual total number of turns of wheels 216. Gear clutches 211 may be engaged or disengaged via adjusting fluid supplied to the gear clutches via shift control solenoid valves 209. Torque output from the automatic transmission 208 may also be relayed to wheels 216 to propel the vehicle via output shaft 260. Specifically, automatic transmission 208 may transfer an input driving torque at the input shaft 270 responsive to a vehicle traveling condition before transmitting an output driving torque to the wheels 216. Transmission controller 254 selectively activates or engages TCC 212, gear clutches 211, and forward clutch 210. Transmission controller also selectively deactivates or disengages TCC 212, gear clutches 211, and forward clutch 210. Transmission controller 254 removes pressurized fluid from gear clutches 211 when transmission 208 is engaged in park. Further, transmission controller 254 engages parking pawl 268 to reduce transmission shaft movement and vehicle movement when transmission shifter 213 is in a park position. A position of shifter (e.g., Park, neutral, or drive) may be indicated via shifter position sensor 214. Parking pawl 268 may engage output shaft 260 or a gear within transmission 208 when transmission 208 is commanded to park. Actuator 267 may engage or disengage parking pawl 268 via commands sent via controller 12.

Further, a frictional force may be applied to wheels 216 by engaging friction wheel brakes 218. In one example, friction wheel brakes 218 may be engaged in response to the driver pressing their foot on a brake pedal (not shown) and/or in response to instructions within brake controller 250. Further, brake controller 250 may apply brakes 218 in response to information and/or requests made by vehicle system controller 255. In the same way, a frictional force may be reduced to wheels 216 by disengaging wheel brakes 218 in response to the driver releasing his foot from a brake pedal, brake controller instructions, and/or vehicle system controller instructions and/or information. For example, vehicle brakes may apply a frictional force to wheels 216 via controller 250 as part of an automated engine stopping procedure.

In response to a request to accelerate vehicle 225, vehicle system controller may obtain a driver demand torque or power request from an accelerator pedal or other device. Vehicle system controller 255 then commands engine 10 in response to the driver demand torque. Vehicle system controller 255 requests the engine torque from engine controller 12. If engine torque is less than a transmission input torque limit (e.g., a threshold value not to be exceeded), the torque is delivered to torque converter 206, which then relays at least a fraction of the requested torque to transmission input shaft 270. Transmission controller 254 selectively locks torque converter clutch 212 and engages gears via gear clutches 211 in response to shift schedules and TCC lockup schedules that may be based on input shaft torque and vehicle speed.

Accordingly, torque control of the various powertrain components may be supervised by vehicle system controller 255 with local torque control for the engine 10, transmission 208, and brakes 218 provided via engine controller 12, transmission controller 254, and brake controller 250.

As one example, an engine torque output may be controlled by adjusting a combination of spark timing, fuel pulse width, fuel pulse timing, and/or air charge, by controlling throttle opening and/or valve timing, valve lift and boost for turbo- or super-charged engines. In the case of a diesel engine, controller 12 may control the engine torque output by controlling a combination of fuel pulse width, fuel pulse timing, and air charge. In all cases, engine control may be performed on a cylinder-by-cylinder basis to control the engine torque output.

Transmission controller 254 receives transmission input shaft position via position sensor 271. Transmission controller 254 may convert transmission input shaft position into input shaft speed via differentiating a signal from position sensor 271 or counting a number of known angular distance pulses over a predetermined time interval. Transmission controller 254 may receive transmission output shaft torque from torque sensor 272. Alternatively, sensor 272 may be a position sensor or torque and position sensors. If sensor 272 is a position sensor, controller 254 may count shaft position pulses over a predetermined time interval to determine transmission output shaft velocity. Transmission controller 254 may also differentiate transmission output shaft velocity to determine transmission output shaft acceleration. Transmission controller 254, engine controller 12, and vehicle system controller 255, may also receive addition transmission information from sensors 277, which may include but are not limited to pump output line pressure sensors, transmission hydraulic pressure sensors (e.g., gear clutch fluid pressure sensors), and ambient temperature sensors.

Brake controller 250 receives wheel speed information via wheel speed sensor 223 and braking requests from vehicle system controller 255. Brake controller 250 may also receive brake pedal position information from brake pedal sensor 154 shown in FIG. 1 directly or over CAN 299. Brake controller 250 may provide braking responsive to a wheel torque command from vehicle system controller 255. Brake controller 250 may also provide anti-skid and vehicle stability braking to improve vehicle braking and stability. As such, brake controller 250 may provide a wheel torque limit (e.g., a threshold negative wheel torque not to be exceeded) to the vehicle system controller 255.

FIGS. 3A and 3B show a cylinder compression ratio changing linkage that changes a compression ratio of an engine 10. FIG. 3A shows compression ratio changing linkage 300 in a first position that increases a compression ratio of cylinder 30. FIG. 3B shows compression ratio changing linkage 300 in a second position that decreases a compression ratio of cylinder 30. Controller 12 may include non-transitory executable instructions to operate the cylinder compression ratio changing linkage at the positions shown and other positions to adjust the engine's compression ratio.

Connecting rod 117 is shown mechanically coupled to upper link 303 via connecting pin 302. Upper link 303 is coupled to crankpin 304 and crankpin 304 is part of crankshaft 40. Crank journal 318 is supported via engine block 33 and crankpin 304 is offset from crank journal 318. Upper link 303 is mechanically coupled to lower link 315 via connecting pin 306. Lower link 315 is mechanically coupled to control link 316 via connecting pin 308. Motor 312 is mechanically coupled to control link 316 via connecting pin 309. Shaft 310 of motor 312 may selectively rotate clockwise or counter clockwise to advance or retract control link 316. Controller 12 may selectively supply electric current to motor 312 and electric current may be monitored via current sensor 350*c*. Current that is supplied to motor 312 to maintain a position of control link 316 may be indicative of force applied to rod 117 since rod 117 is mechanically coupled to control link 316. Thus, motor 312 may be applied as a force sensor coupled to control link 316. In some examples, strain gauge 350*b* may be mechanically coupled to lower control line 315 to determine force applied to rod 117. Alternatively, strain gauge 350*a* may be mechanically coupled to control link 316 to determine force applied to rod 117.

FIG. 3A shows control link 316 in an extended state via motor shaft 310 rotating counter clockwise, which causes upper link 303 to rotate, thereby changing an angle between rod 117 and upper link 303. FIG. 3B shows control link 316 in a retracted state via motor shaft 310 rotating clockwise, which causes upper link 303 to rotate and change the angle between rod 117 and upper link 303. FIG. 3A shows compression ratio changing linkage 300 in a high compression state (e.g., 14:1 compression ratio) and FIG. 3B shows compression ratio changing linkage 300 in a low compression state (e.g., 8:1 compression ratio).

Thus, the system of FIGS. 1-3B provides for a vehicle system, comprising: an engine including a compression ratio adjustment linkage; an automatic transmission coupled to the engine; and a controller including executable instructions stored in non-transitory memory to change the engine's compression ratio via the compression ratio adjustment linkage according to an increasing or decreasing accelerator pedal position and a forecast gear shifting of the automatic transmission from a first gear to a second gear. The system further comprises additional instructions to change the engine's compression ratio before shifting the automatic transmission from the first gear to the second gear. The system includes where changing the engine's compression ratio includes decreasing the engine's compression ratio. The system further comprises additional instructions to change the engine's compression ratio immediately after shifting the automatic transmission from the first gear to the second gear. The system includes where changing the engine's compression ratio includes increasing the engine's compression ratio. The system includes where forecasting the shifting of the transmission includes anticipating an accelerator pedal position and anticipating a vehicle speed.

Referring now to FIG. 4, a plot of an example transmission gear shifting schedule is shown. The vertical axis represents accelerator pedal position and the accelerator pedal position increases (e.g., is further applied or depressed) in the direction of the vertical axis arrow. The horizontal axis represents vehicle speed and vehicle speed increases in the direction of the horizontal axis arrow.

Solid lines 402, 404, 406, 409, and 410 are transmission gear upshift lines and dot-dot-dash lines 401, 403, 405, 407, and 408 are transmission gear downshift lines. Specifically, line 402 is an upshift curve for a 1>2 gear shift. Line 404 is an upshift curve for a 2>3 gear shift. Line 406 is an upshift line for a 3>4 gear shift. Line 409 is an upshift curve for a 4>5 gear shift. Line 410 is an upshift curve for a 5>6 gear shift. Line 401 is a downshift curve for a 2>1 gear shift. Line 403 is a downshift curve for a 3>2 gear shift. Line 405 is a downshift curve for a 4>3 gear shift. Line 407 is a downshift curve for a 5>4 gear shift. Line 408 is a downshift curve for a 6>5 gear shift.

The transmission is upshifted if the intersection of accelerator pedal position and vehicle speed at the present time intersects an upshift curve. The transmission is downshifted if the intersection of accelerator pedal position and vehicle speed at the present time intersects with a downshift curve.

FIG. 4 shows how a change in accelerator pedal position and vehicle speed may be used to forecast, anticipate, or predict a gear shift. In particular, if accelerator pedal position and vehicle speed intersect at point 450 at a first time and a short time later accelerator pedal position and vehicle speed intersect at 451, then the rate of change of accelerator pedal position and vehicle speed may be used to predict that accelerator pedal position and vehicle speed will be at point 453 at a future time. Line 452 is an extension of the line between points 450 and 451, which allows a prediction of vehicle speed and accelerator pedal position reaching point 453. The time that line 452 intersects with line 405 is a time when the transmission is expected, predicted, or anticipated to downshift in response to accelerator pedal position and vehicle speed. Thus, if a gear shift prediction is based on the accelerator pedal moving from point 450 to 451, then a downshift from 4>3 is predicted. The method of FIG. 7 explains the gear shift prediction in greater detail.

Figure 5:
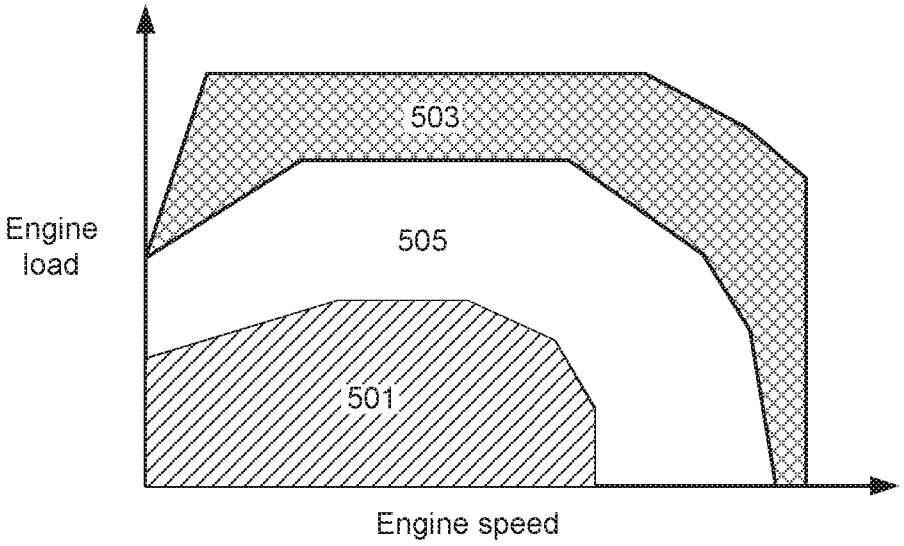
FIG. 5 shows a plot of an example engine compression ratio map.

Referring now to FIG. 5, an example engine compression ratio map is shown. In this example, the engine compression ratio is adjusted based on engine load and engine speed. However, in other examples, the engine compression ratio may be adjusted responsive to other engine parameters (e.g., engine torque and engine speed).

The vertical axis represents engine load (e.g., the actual air mass flowing through the engine divided by the theoretical maximum air mass flowing through the engine) and engine load increases in the direction of the vertical axis arrow. The horizontal axis represents engine speed and engine speed increases in the direction of the horizontal axis arrow.

At lower engine speeds and loads the engine (e.g., region 501) the engine is operated with a higher compression ratio (e.g., 14:1). At higher engine speeds and loads the engine (e.g., region 503) the engine is operated with a lower compression ratio (e.g., 8:1). At medium engine speeds and loads the engine (e.g., region 505) the engine is operated with an intermediate compression ratio (e.g., between 14:1 and 8:1).

Figure 6:
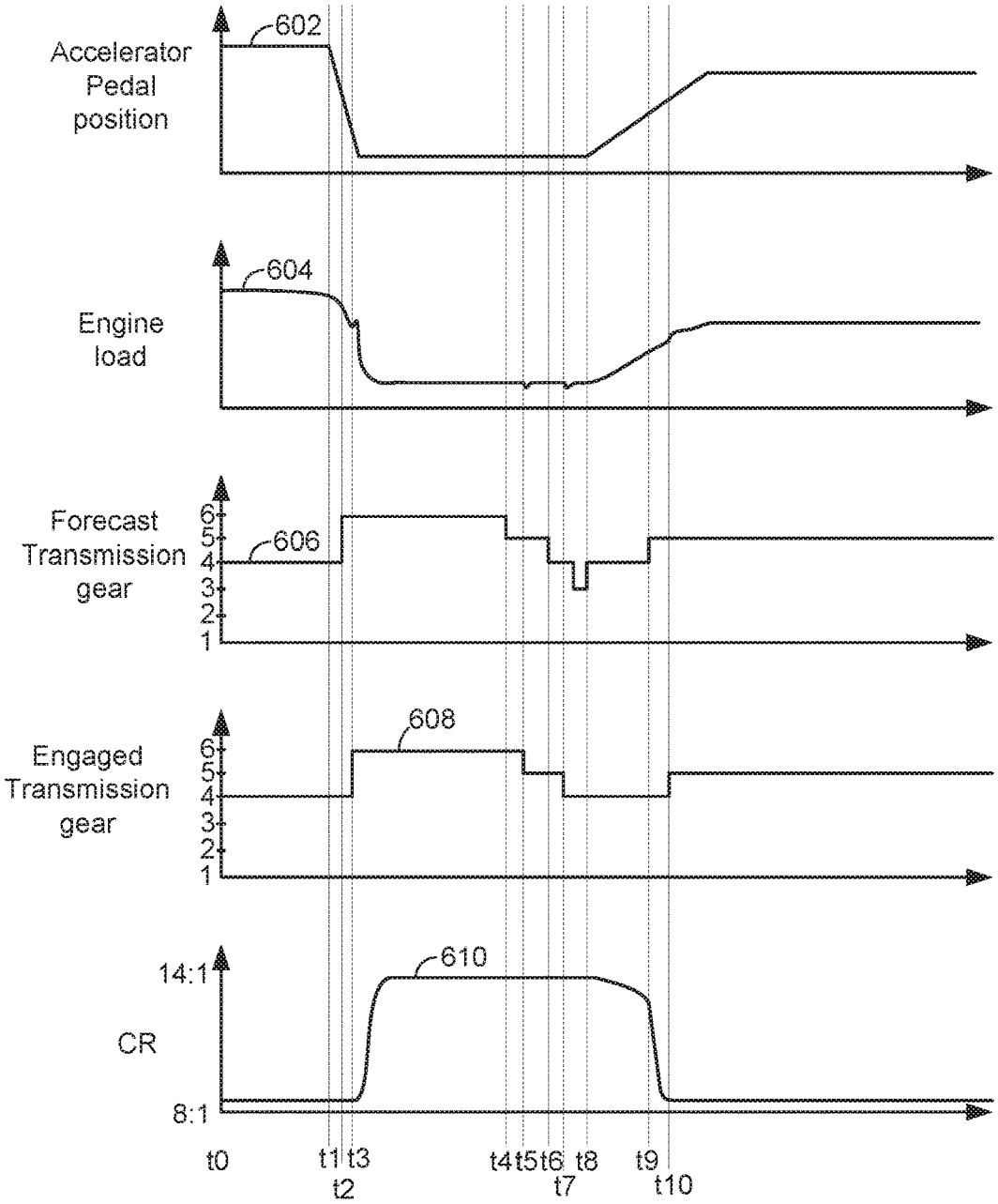
FIG. 6 shows a plot of an example engine operating sequence according to the method of FIGS. 7-11.

Referring now to FIG. 6, plot showing a prophetic engine operating sequence is shown. The sequence of FIG. 6 may be provided via the system of FIGS. 1-3B in cooperation with the method of FIGS. 7-11. The plots of FIG. 6 are time aligned and they occur at the same time. Vertical lines at time t0-t10 represent times of interest in the sequence. Controller 12 may include non-transitory executable instructions to operate the engine at the conditions shown and discussed in the description of FIG. 6.

The first plot of FIG. 6 is a plot of accelerator pedal position versus time. The vertical axis represents accelerator pedal position and the accelerator pedal position increases in the direction of the vertical axis arrow. The horizontal axis represents time and time increases from the left side of the figure to the right side of the figure. Curve 602 represents accelerator pedal position.

The second plot of FIG. 6 is a plot of engine load versus time. The vertical axis represents engine load and engine load increases in the direction of the vertical axis arrow. Trace 604 represents engine load. Engine load may be represented as a value that ranges from 0 to 1, where 0 is no engine load and 1 is full engine load. The horizontal axis represents time and time increases from the left side of the figure to the right side of the figure.

The third plot of FIG. 6 is a plot of forecasted, predicted, or anticipated transmission gear method versus time. The vertical axis represents forecasted, predicted, or anticipated transmission gear and the forecasted, predicted, or anticipated transmission gear are indicated along the vertical axis. Trace 606 represents forecasted, predicted, or anticipated transmission gear. The horizontal axis represents time and time increases from the left side of the figure to the right side of the figure.

The fourth plot of FIG. 6 is a plot of engaged transmission gear versus time. The vertical axis represents engaged transmission and the engaged transmission is indicated along the vertical axis. Trace 608 represents engaged transmission. The horizontal axis represents time and time increases from the left side of the figure to the right side of the figure.

The fifth plot of FIG. 6 is a plot of engine compression ratio (CR) versus time. The vertical axis represents engine compression ratio and engine compression ratio increases in the direction of the vertical axis arrow. Trace 610 represents engine compression ratio. The horizontal axis represents time and time increases from the left side of the figure to the right side of the figure.

At time t0, the accelerator pedal is depressed a large amount and the engine load is high. The forecast transmission gear ratio is $4^{th}$ gear and the engaged transmission gear is $4^{th}$ gear. The engine compression ratio is set to a low value to reduce the possibility of engine knock.

At time t1, the human driver (not shown) begins to release the accelerator pedal (e.g., a tip-out condition) and the engine load begins to decline as the engine's throttle (not shown) is closed in response to the accelerator pedal position. The forecast transmission gear and engaged transmission gear remain unchanged and the engine compression ratio remains low.

At time t2, the forecast transmission gear changes from $4^{th}$ gear to $6^{th}$ gear indicating that an upshift is expected. The transmission gear change is forecast as described in greater detail in the description of method 700. The accelerator pedal position and the engine load continue to decline and the transmission is still engaged in $4^{th}$ gear. The engine compression ratio is unchanged.

At time t3, the engaged transmission gear changes from $4^{th}$ gear to $6^{th}$ gear. The forecast transmission gear remains $6^{th}$ gear and the engine compression ratio is maintained at a low level even though engine load is decreasing so that no change in compression ratio is made during the transmission gear shift. This may reduce the possibility of driveline torque disturbances. The engine load is increased briefly since the gear change causes a reduction in engine speed and an increase in engine load to maintain engine torque. The compression ratio begins to change to a high compression ratio after the gear shift is complete so that engine efficiency may be increased.

Between time t3 and time t4, the engine compression ratio is changed from the low compression ratio to the high compression ratio. The accelerator pedal position and engine load finish declining and then remain at a low level. The transmission remains engaged in $6^{th}$ gear and the forecast transmission gear remains $6^{th}$ gear.

At time t4, the vehicle speed is declining (not shown) so the transmission is forecast to downshift to $5^{th}$ gear. The accelerator pedal remains not applied and engine load remains low. The transmission remains engaged in $6^{th}$ gear and the engine compression ratio remains high.

At time t5, the transmission engaged gear changes from $6^{th}$ to $5^{th}$ and gear change decreases the engine load by a small amount since engine speed is increased and engine torque (not shown) is maintained. The accelerator pedal position remains unchanged and the forecast transmission gear remains $5^{th}$ gear. The engine compression ratio remains high.

At time t6, the vehicle speed continues declining (not shown) so the transmission is forecast to downshift to $4^{th}$ gear. The accelerator pedal remains not applied and engine load remains low. The transmission remains engaged in $5^{th}$ gear and the engine compression ratio remains high.

At time t7, the transmission engaged gear changes from $5^{th}$ to $4^{th}$ and gear change decreases the engine load by a small amount since engine speed is increased and engine torque (not shown) is maintained. The accelerator pedal position remains unchanged and the forecast transmission gear remains $4^{th}$ gear. The engine compression ratio remains high.

Between time t7 and time t8, the forecast transmission gear changes from $4^{th}$ gear to $3^{rd}$ gear, but $3^{rd}$ gear is not engaged in the transmission. The accelerator pedal position remains unchanged and the engine load remains low after it changed due to the gear shift at time t7.

At time t8, the human driver begins to apply the accelerator pedal and the engine load begins to increase. The forecast transmission gear changes from $3^{rd}$ gear to $4^{th}$ gear and the transmission remains engaged in $4^{th}$ gear. The engine compression ratio remains high, but it is adjusted to a lower level based on engine speed (not shown) and load.

At time t9, the accelerator pedal position continues to increase and the engine load continues to increase. The transmission is forecast to upshift to $5^{th}$ gear and the transmission remains engaged in $4^{th}$ gear. The engine compression ratio begins to be adjusted to a lowest level based on the forecasted transmission gear and the accelerator pedal position. The forecasted transmission gear is an upshift so that the upshift will result in a low engine speed and a higher engine load to maintain a level of engine torque before the upshift. Lowering the engine compression ratio may reduce the possibility of engine knock that may occur due to the transmission gear shift. The engine compression ratio is lowered before the forecast transmission gear is engaged so that the engine may not knock as a result of the transmission gear change.

At time t10, $5^{th}$ gear is engaged in the transmission and the engine load is increased due to the transmission being upshifted while the accelerator pedal position is increasing. The engine is operating with a low compression ratio and the forecast transmission gear remains $5^{th}$ gear.

In this way, the engine compression ratio may be changed after a gear shift when the gear shift is expected to increase engine load and the engine is operating with a low compression ratio before the gear shift. Alternatively, the engine compression ratio may be changed before the gear shift when the gear shift is expected to increase engine load and the engine is operating with a high compression ratio before the gear change so that the possibility of engine knock may be avoided.

Figure 7:
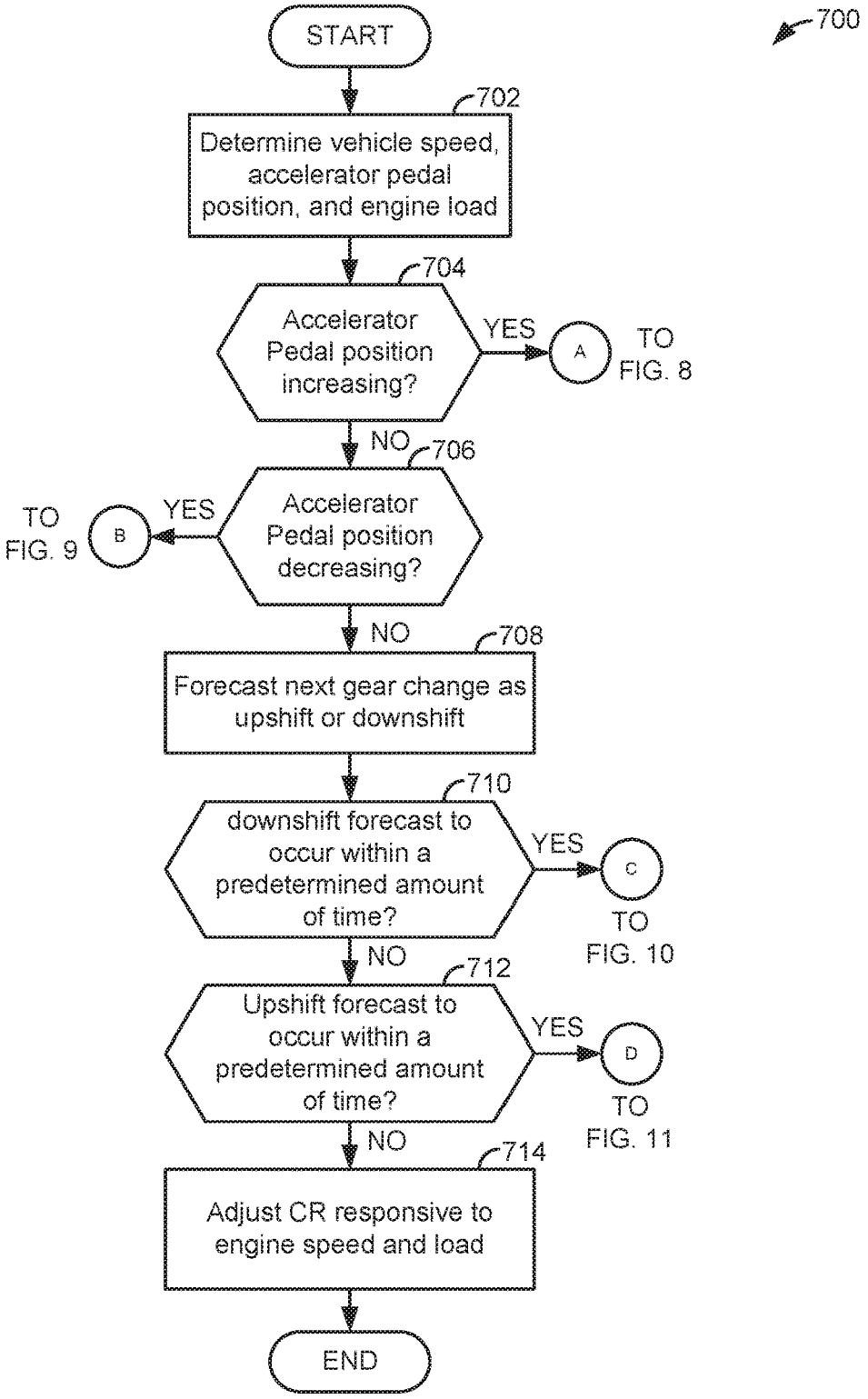
FIGS. 7-11 show a flowchart of an example method for operating a variable compression ratio engine.
Figure 8:
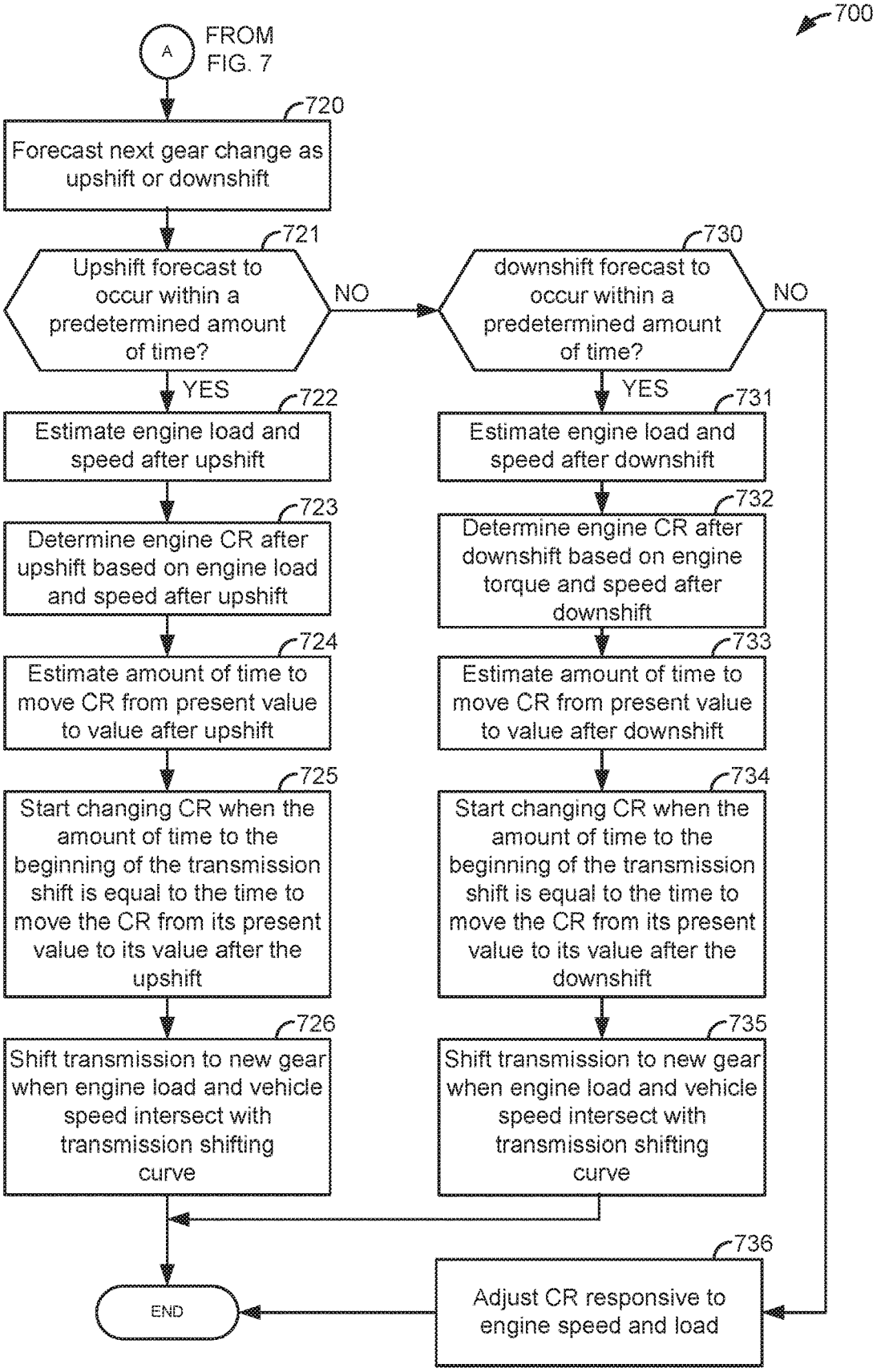
Figure 9:
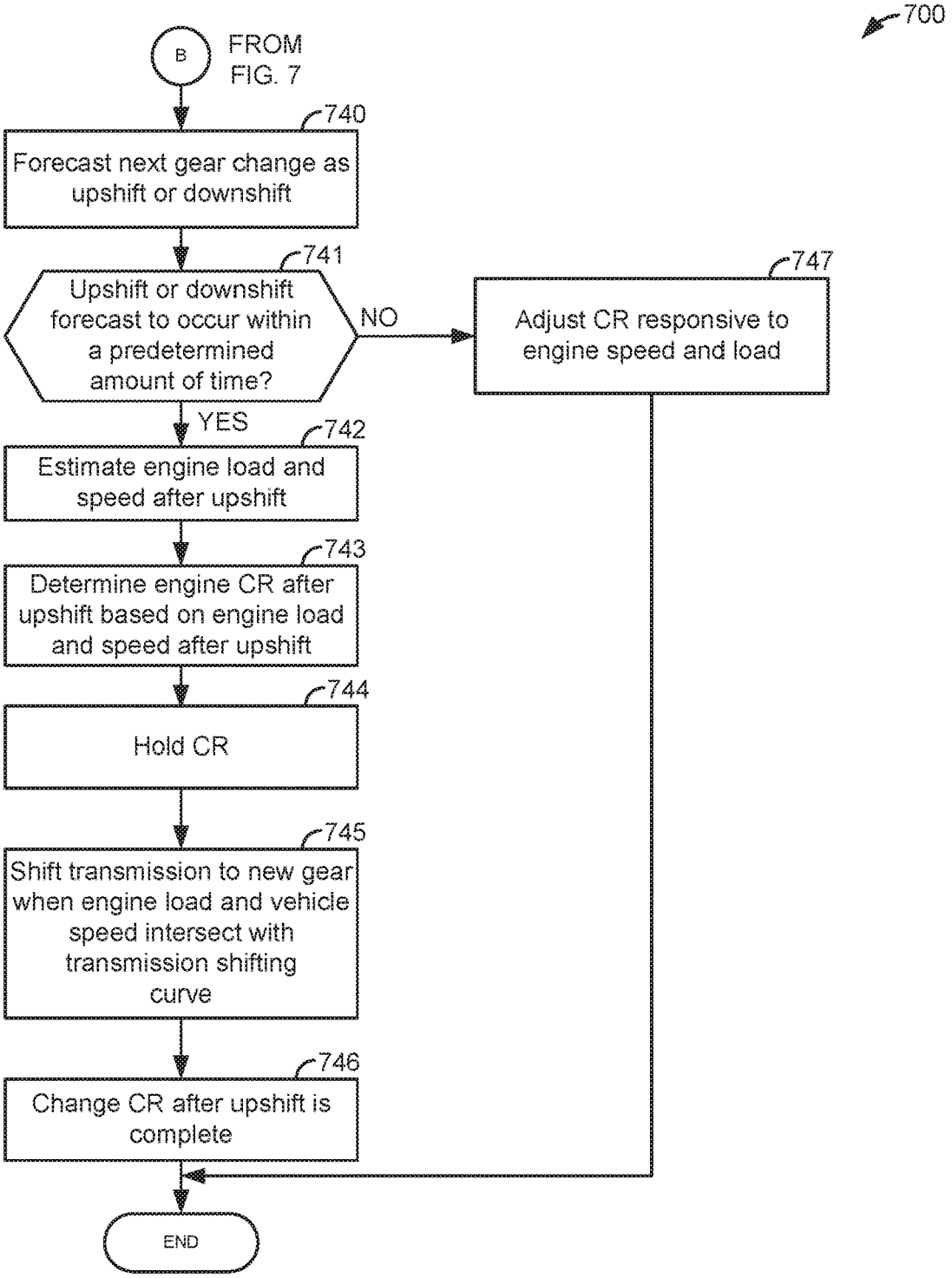
Figure 10:
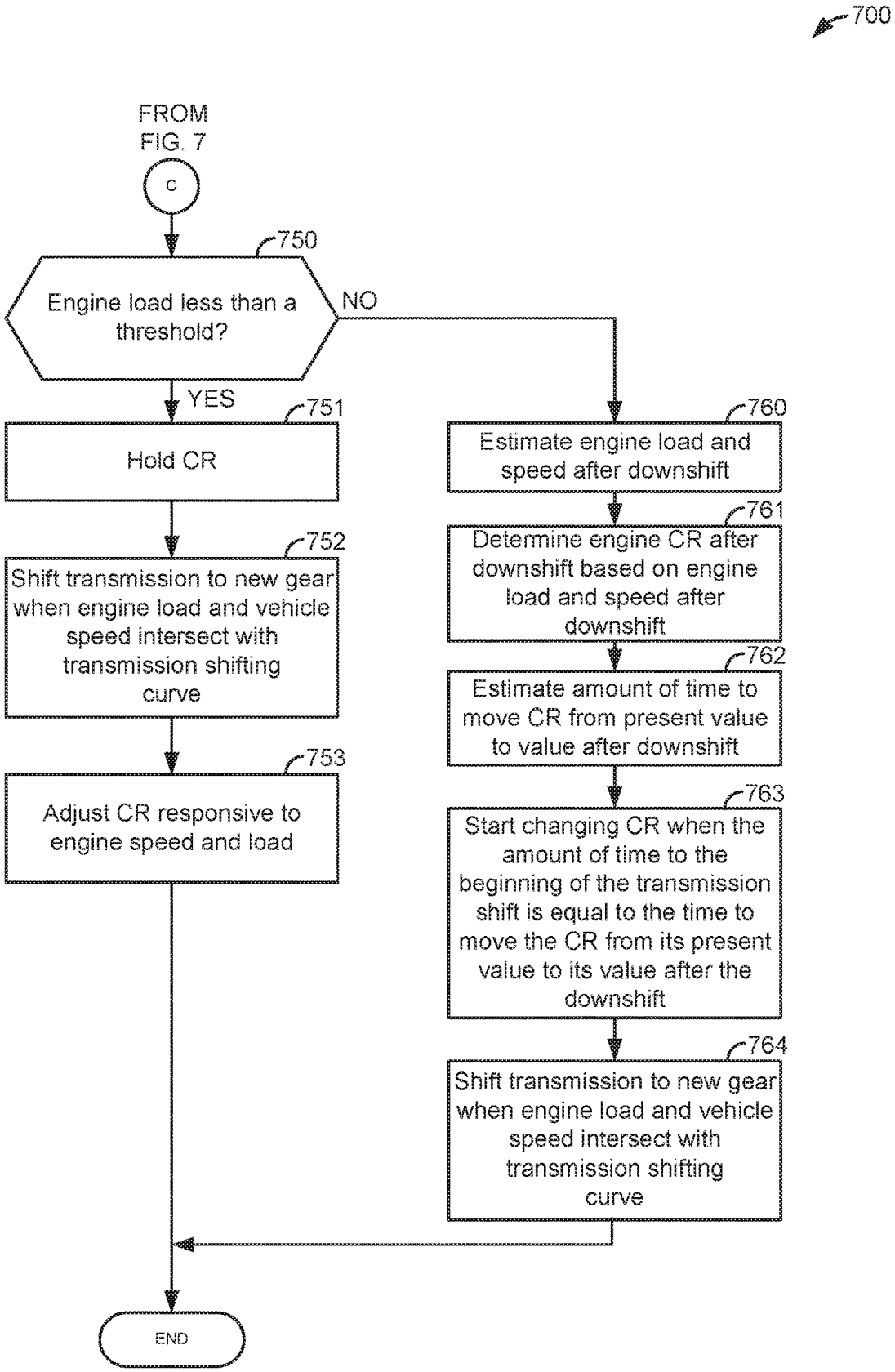
Figure 11:
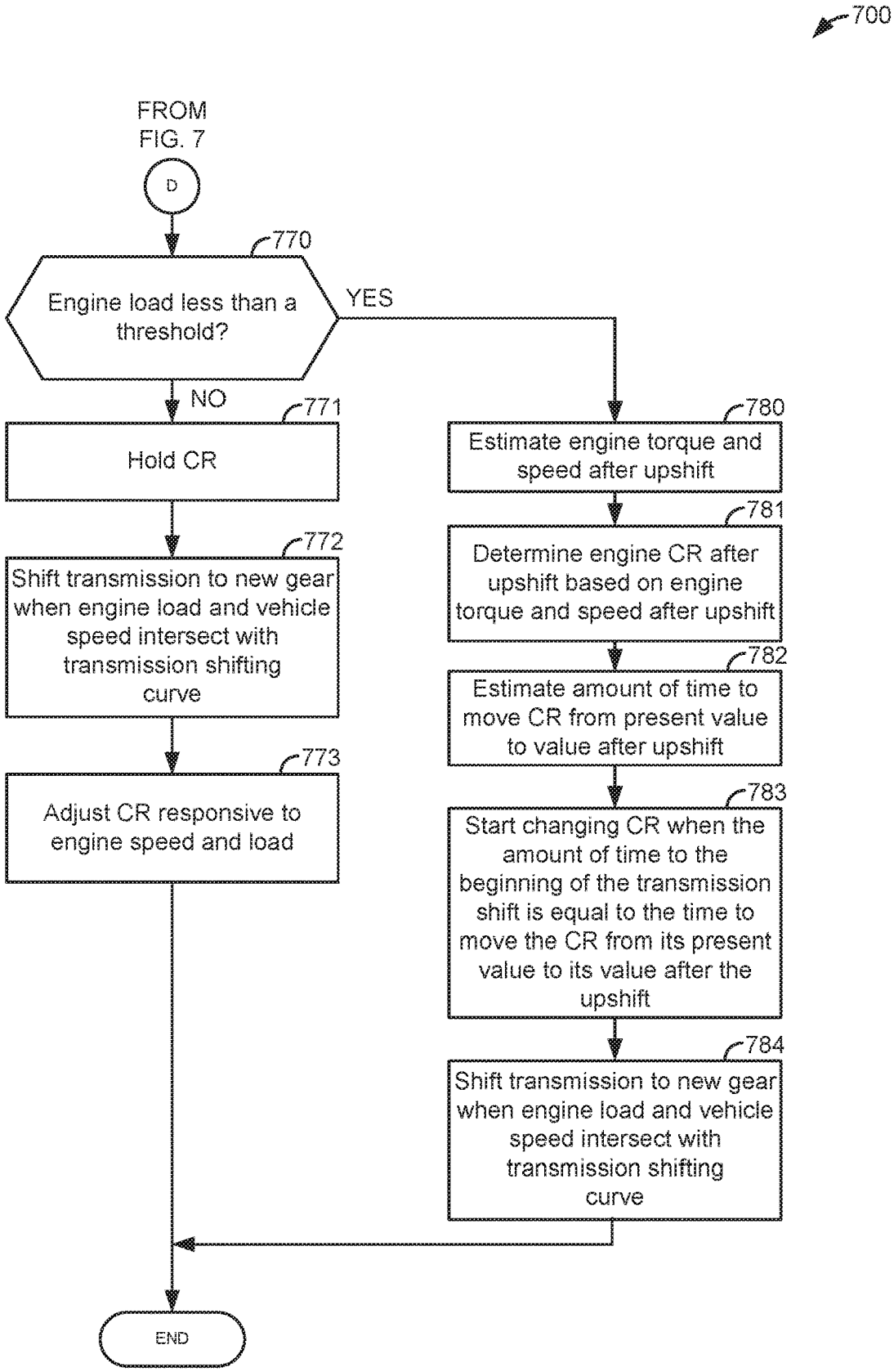

Referring now to FIG. 7, a flowchart for operating an engine is shown. At least portions of the method of FIG. 7 may be incorporated as executable instructions stored in non-transitory memory of the system shown in FIGS. 1-3B. Additionally, portions of the method of FIG. 7 may take place in the physical world as operations or actions performed by a controller to transform an operating state of one or more devices. Some of the control parameters described herein may be determined via receiving input from the sensors and actuators described herein. The method of FIG. 7 may also provide the operating sequence shown in FIG. 6. Further, the engine may be operated at the conditions mentioned in method 700. The engine controller may also include executable instructions stored in non-transitory memory to operate the engine at the conditions mentioned in method 700.

At 702, method 700 determines vehicle operating conditions including but not limited to vehicle speed, accelerator pedal position, engine speed, engine load, and engine temperature. The various vehicle operating conditions may be determined via sensors. Method 700 proceeds to 704.

At 704, method 700 judges whether or not accelerator pedal position is increasing (e.g., is being applied further). In one example, method 700 may compute a derivative of accelerator pedal position from accelerator pedal sensor output taken at two different times. If the sign of the derivative is positive, method 700 may determine that the accelerator pedal position is increasing. If method 700 determines that accelerator pedal position is increasing, the answer is yes and method 700 proceeds to 720 of FIG. 8. Otherwise, method 700 proceeds to 706.

At 706, method 700 judges whether or not accelerator pedal position is decreasing (e.g., is being at least partially released). If the sign of the derivative of accelerator pedal position determined at 704 is negative, method 700 may determine that the accelerator pedal position is decreasing. If method 700 determines that accelerator pedal position is decreasing, the answer is yes and method 700 proceeds to 740 of FIG. 9. Otherwise, method 700 proceeds to 708.

At 708, method forecasts, predicts, or anticipates a next gear to be engaged by the transmission. In one example, accelerator pedal position and vehicle speed are measured at a first time (e.g., accelerator pedal position=200 counts and vehicle speed=30 Kph). Further, method 700 measures accelerator pedal position and vehicle speed at a second time (e.g., accelerator pedal position=300 counts and vehicle speed=32 Kph). Then, method 700 determines the rate of change of accelerator pedal position and the rate of vehicle speed change between the two points. In this example, the rate of change of accelerator position is 100 counts/second (e.g., (300−200 counts)/1 second) when the time between samples is 1 second. The rate of vehicle acceleration change is 2 Kph/second (32−30 Kph/1 second).

The next transmission gear may be forecast at a predetermined time in the future (e.g., 2 seconds from the present time). In one example, the predetermined amount of time is an amount of time it takes for the compression ratio actuator to change the engine's compression ratio by a specified amount (e.g., the full range of authority 8:1 to 14:1 or a partial range of authority 8:1 to 12:1, or vice-versa). Consequently, if it takes the compression ratio two seconds to fully advance, then method 700 forecasts a transmission gear ratio two seconds into the future by extending the line between the two presently measured points (e.g., 200 counts/30 Kph and 300 counts/32 Kph) two seconds into the future. Since it is been determined that the accelerator pedal position is changing by 100 counts/second, the accelerator pedal position two seconds in the future is 300 counts+2 seconds(100 counts/second)=500 counts. Similarly, the vehicle speed two seconds into the future is 32 Kph+2(2 Kph/sec)=36 Kph. If the intersection of the forecasted accelerator pedal position and the forecasted vehicle speed in the shift schedule crosses an upshift curve or downshift curve, then the forecast transmission gear is the gear described by the upshift curve or the downshift curve. If the intersection of the forecasted accelerator pedal position and the forecasted vehicle speed crosses more than one upshift curve or one downshift curve, then the forecast transmission gear is the gear described by the upshift curve or downshift curve that is closest to the forecasted accelerator pedal position and the forecasted vehicle speed at the predetermined amount of time in the future. For example, if the transmission is engaged in fourth gear and the forecast accelerator pedal position and vehicle acceleration passes through a boundary of the 4>3 downshift curve, then the transmission gear forecast by method 700 is $3^{rd}$ gear. Conversely, if the transmission is engaged in fourth gear and the forecast accelerator pedal position and vehicle acceleration passes through a boundary of the 4>5 upshift curve, then the transmission gear forecast by method 700 is $5^{th}$ gear. FIG. 4 shows this concept graphically via points 450, 451, and 453. If the transmission is engaged in fourth gear and the forecast accelerator pedal position and vehicle acceleration do not pass through a boundary of an upshift curve or a downshift curve, then the transmission gear forecast by method 700 remains the presently engaged gear. Method 700 proceeds to 710 after forecasting the transmission gear.

At 710, method 700 judges whether or not a transmission gear downshift is forecast within a predetermined amount of time (e.g., the predetermined amount of time described at 708). If so, the answer is yes and method 700 proceeds to 750 of FIG. 10. Otherwise, method 700 proceeds to 712.

At 712, method 700 judges whether or not a transmission gear upshift is forecast within a predetermined amount of time (e.g., the predetermined amount of time described at 708). If so, the answer is yes and method 700 proceeds to 770 of FIG. 11. Otherwise, method 700 proceeds to 714.

At 714, method 700 adjusts the engine compression ratio responsive to engine speed and load. In one example, method 700 adjusts the engine compression ratio to a compression ratio that is defined in a map as shown in FIG. 5. The engine compression ratio may be adjusted via an actuator as shown in FIGS. 3A and 3B and controller 12. Thus, as engine speed and load vary, the engine compression ratio may be increased or decreased to improve engine efficiency. Method 700 proceeds to exit.

At 720, method 700 forecasts, predicts, or anticipates a next gear to be engaged by the transmission. In one example, forecasts a next transmission gear as described at 708. Method 700 proceeds to 721 after forecasting the transmission gear.

At 721, method 700 judges whether or not a transmission gear upshift is forecast within a predetermined amount of time (e.g., the predetermined amount of time described at 708). If so, the answer is yes and method 700 proceeds to 722. Otherwise, method 700 proceeds to 730.

At 722, method 700 estimates what the engine load and engine speed will be immediately following the forecasted upshift. In one example, method 700 estimates the engine speed immediately following the forecasted upshift by dividing the vehicle speed that is forecasted immediately following the upshift (e.g., the vehicle speed forecast at 720) by the combined ratio of the forecasted gear and the vehicle's axle. The result is then divided by the distance the tire travels in a single rotation. The forecast engine load may be determined via a lookup table that is referenced by engine speed and engine torque immediately before the gear shift. The engine load output from the table is modified for engine air-fuel ratio and spark timing. For example, forecast engine load=$f$(forecast_engine_speed, engine_torque), where $f$ is a function that outputs empirically determined values of engine torque, forecast_engine_speed is forecasted engine speed (e.g., engine speed immediately following the shift), and engine_torque is engine torque immediately before the shift). In one example, the values in the function $f$ may be determined via operating the engine connected to a dynamometer and monitoring engine speed, engine load, and engine torque. Method 700 proceeds to 723 after determining the forecasted engine speed and load values.

At 723, method 700 determines forecast engine compression ratio at the predetermined time in the future. The forecast engine compression ratio is based on the forecast engine load and speed that were determined at 722. In one example, the forecast engine load and speed are applied as indexes or reference values into an engine compression ratio map (e.g., as shown in FIG. 5) and the engine compression ratio map outputs an engine compression ratio value. The operation may be expressed as engine CR=ENG_CR(forecast engine speed, forecast engine load), where CR is the forecast engine compression ratio, ENG_CR is an engine compression ratio map, and forecast engine speed and load are arguments for referencing the function or table ENG_CR. Method 700 proceeds to 724.

At 724, method 700 estimates an amount of time it will take to move the engine's compression ratio from its present value to the forecast engine compression ratio at the predetermined time in the future. In one example, a function describing movement of the engine compression ratio is referenced by the change in the engine compression ratio from its present value to its forecasted value. For example, if the present engine compression ratio is 8:1 and the forecasted engine compression ratio is 10:1, the function describing movement of the engine compression ratio is referenced or indexed via a value of 2:1 (e.g., 10:1−8:1=2:1). The operation may be described as amount of time to change engine compression ratio=CR_time (CR_Δ), where CR_time is a function that outputs an amount of time to change the engine compression ratio and CR_Δ is the change in compression ratio (e.g., 2:1). The values in the function CR_time may be determined via operating the engine, demanding a compression ratio change, and recording an amount of time it takes for the compression ratio changing device to change the engine's compression ratio from its initial value to its demanded value. Method 700 proceeds to 725 after the time to change the engine's compression ratio is estimated.

At 725, method 700 begins to change the engine's compression ratio from its present value to the forecasted value when the amount of time to the beginning of the forecasted transmission shift is equal to the time it takes to move the engine compression ratio from its present value to the forecasted engine compression ratio (e.g., the engine compression ratio based on engine speed and load immediately following the upshift) plus a threshold amount of time. For example, if it takes 0.5 seconds to move the engine's compression ratio from its present value of 14:1 to the forecasted engine compression ratio of 8:1 (e.g., the engine compression ratio that is based on engine speed and load that immediately follows the present upshift), and the forecasted transmission upshift is 2 seconds in the future, then the engine compression ratio begins to change 1.5 seconds in the future minus the threshold amount of time (e.g., an amount of time to ensure that the compression ratio change is complete (e.g., 0.1 second)). Thus, if the transmission is forecast to shift 2 seconds in the future from the present time, it takes 0.5 seconds to change the engine compression ratio, and the threshold amount of time is 0.1 seconds, then the compression ratio begins to change to the forecast value 1.4 seconds in the future. The compression ratio change is completed before the transmission upshifts to reduce the possibility of engine knock. Method 700 proceeds to 726.

At 726, method 700 shifts the transmission to the forecasted or new gear when the engine speed and accelerator pedal position intersect a shift curve in the transmission shift schedule. Method 700 proceeds to exit after upshifting the transmission.

At 730, method 700 judges whether or not a transmission gear downshift is forecast within a predetermined amount of time (e.g., the predetermined amount of time described at 708). If so, the answer is yes and method 700 proceeds to 731. Otherwise, method 700 proceeds to 736.

At 731, method 700 estimates what the engine load and engine speed will be immediately following the forecasted downshift. In one example, method 700 estimates the engine speed immediately following the forecasted upshift by dividing the vehicle speed that is forecasted immediately following the upshift (e.g., the vehicle speed forecast at 720) by the combined ratio of the forecasted gear and the vehicle's axle. The result is then divided by the distance the tire travels in a single rotation. The forecast engine load may be determined via a lookup table that is referenced by engine speed and engine torque immediately before the gear shift. The engine load output from the table is modified for engine air-fuel ratio and spark timing. For example, forecast engine load=ƒ(forecast_engine_speed, engine_torque), where ƒ is a function that outputs empirically determined values of engine torque, forecast_engine_speed is forecasted engine speed (e.g., engine speed immediately following the shift), and engine_torque is engine torque immediately before the shift). In one example, the values in the function ƒ may be determined via operating the engine connected to a dynamometer and monitoring engine speed, engine load, and engine torque. Method 700 proceeds to 732 after determining the forecasted engine speed and load values.

At 732, method 700 determines forecast engine compression ratio at the predetermined time in the future. The forecast engine compression ratio is based on the forecast engine load and speed that were determined at 731. In one example, the forecast engine load and speed are applied as indexes or reference values into an engine compression ratio map (e.g., as shown in FIG. 5) and the engine compression ratio map outputs an engine compression ratio value. The operation may be expressed as engine CR=ENG_CR(forecast engine speed, forecast engine load), where CR is the forecast engine compression ratio, ENG_CR is an engine compression ratio map, and forecast engine speed and load are arguments for referencing the function or table ENG_CR. Method 700 proceeds to 733.

At 733, method 700 estimates an amount of time it will take to move the engine's compression ratio from its present value to the forecast engine compression ratio at the predetermined time in the future. In one example, a function describing movement of the engine compression ratio is referenced as previously described by the change in the engine compression ratio from its present value to its forecasted value. Method 700 proceeds to 734 after the time to change the engine's compression ratio is estimated.

At 734, method 700 begins to change the engine's compression ratio from its present value to the forecasted value when the amount of time to the beginning of the forecasted transmission downshift is equal to the time it takes to move the engine compression ratio from its present value to the forecasted engine compression ratio (e.g., the engine compression ratio based on engine speed and load immediately following the upshift) plus a threshold amount of time. Thus, if the transmission is forecast to shift 2 seconds in the future from the present time, it takes 0.5 seconds to change the engine compression ratio, and the threshold amount of time is 0.1 seconds, then the compression ratio begins to change to the forecast value 1.4 seconds in the future. The compression ratio change is completed before the transmission downshifts to reduce the possibility of engine knock. Method 700 proceeds to 735.

At 735, method 700 shifts the transmission to the forecasted or new gear when the engine speed and accelerator pedal position intersect a shift curve in the transmission shift schedule. Method 700 proceeds to exit after downshifting the transmission.

At 736, method 700 adjusts the engine compression ratio responsive to engine speed and load. In one example, method 700 adjusts the engine compression ratio to a compression ratio that is defined in a map as shown in FIG. 5. The engine compression ratio may be adjusted via an actuator as shown in FIGS. 3A and 3B and controller 12. Thus, as engine speed and load vary, the engine compression ratio may be increased or decreased to improve engine efficiency. Method 700 proceeds to exit.

At 740, method 700 forecasts, predicts, or anticipates a next gear to be engaged by the transmission. In one example, forecasts a next transmission gear as described at 708. Method 700 proceeds to 741 after forecasting the transmission gear.

At 741, method 700 judges whether or not a transmission gear upshift is forecast within a predetermined amount of time (e.g., the predetermined amount of time described at 708). If so, the answer is yes and method 700 proceeds to 742. Otherwise, method 700 proceeds to 747.

At 742, method 700 estimates what the engine load and engine speed will be immediately following the forecasted upshift. In one example, method 700 estimates the engine speed immediately following the forecasted upshift by dividing the vehicle speed that is forecasted immediately following the upshift (e.g., the vehicle speed forecast at 720) by the combined ratio of the forecasted gear and the vehicle's axle. The result is then divided by the distance the tire travels in a single rotation. The forecast engine load may be determined via converting accelerator pedal position into an engine torque via a function of accelerator pedal position and vehicle speed at the predetermined time in the future. Once the forecast engine torque is determined, forecast engine load may be determined via a function or table that describes forecast engine load as a function of forecast engine speed and forecast engine torque. Method 700 proceeds to 743 after determining the forecasted engine speed and load values.

At 743, method 700 determines forecast engine compression ratio at the predetermined time in the future. The forecast engine compression ratio is based on the forecast engine load and speed that were determined at 742. In one example, the forecast engine load and speed are applied as indexes or reference values into an engine compression ratio map (e.g., as shown in FIG. 5) and the engine compression ratio map outputs an engine compression ratio value. Method 700 proceeds to 744.

At 744, method 700 prevents the engine compression ratio from changing beginning a predetermined amount of time before the forecast transmission gear shift. For example, if the forecast transmission gear shift is in 2 seconds, the engine compression ratio may not be adjusted within 0.5 seconds of the forecasted transmission gear shift. This may reduce the possibility of driveline torque disturbances during the gear shift. Method 700 proceeds to 745.

At 745, method 700 shifts the transmission to the forecasted or new gear when the engine speed and accelerator pedal position intersect a shift curve in the transmission shift schedule. Method 700 proceeds to 746 after upshifting the transmission.

At 746, method 700 begins to change the engine's compression ratio from its present value based on the present engine speed and engine load after the forecasted transmission upshift. Method 700 proceeds to exit after adjusting the engine compression ratio.

At 747, method 700 adjusts the engine compression ratio responsive to engine speed and load. In one example, method 700 adjusts the engine compression ratio to a compression ratio that is defined in a map as shown in FIG. 5. The engine compression ratio may be adjusted via an actuator as shown in FIGS. 3A and 3B and controller 12. Thus, as engine speed and load vary, the engine compression ratio may be increased or decreased to improve engine efficiency. Method 700 proceeds to exit.

At 750, method 700 judges whether or not engine load is less than a threshold engine load. If so, the answer is yes and method 700 proceeds to 751. Otherwise, method 700 proceeds to 760.

At 751, method 700 prevents the engine compression ratio from changing beginning a predetermined amount of time before the forecast transmission gear shift. For example, if the forecast transmission gear shift is in 2 seconds, the engine compression ratio may not be adjusted within 0.5 seconds of the forecasted transmission gear shift. This may reduce the possibility of driveline torque disturbances during the gear shift. Method 700 proceeds to 752.

At 752, method 700 shifts the transmission to the forecasted or new gear when the engine speed and accelerator pedal position intersect a shift curve in the transmission shift schedule. Method 700 proceeds to 753 after downshifting the transmission.

At 753, method 700 begins to change the engine's compression ratio from its present value based on the present engine speed and engine load after the forecasted transmission downshift. Method 700 proceeds to exit after adjusting the engine compression ratio.

At 760, method 700 estimates what the engine load and engine speed will be immediately following the forecasted downshift. In one example, method 700 estimates the engine speed immediately following the forecasted upshift by dividing the vehicle speed that is forecasted immediately following the upshift (e.g., the vehicle speed forecast at 720) by the combined ratio of the forecasted gear and the vehicle's axle. The result is then divided by the distance the tire travels in a single rotation. The forecast engine load may be determined via converting accelerator pedal position into an engine torque via a function of accelerator pedal position and vehicle speed at the predetermined time in the future. Once the forecast engine torque is determined, forecast engine load may be determined via a function or table that describes forecast engine load as a function of forecast engine speed and forecast engine torque. Method 700 proceeds to 761 after determining the forecasted engine speed and load values.

At 761, method 700 determines forecast engine compression ratio at the predetermined time in the future. The forecast engine compression ratio is based on the forecast engine load and speed that were determined at 760. In one example, the forecast engine load and speed are applied as indexes or reference values into an engine compression ratio map (e.g., as shown in FIG. 5) and the engine compression ratio map outputs an engine compression ratio value. Method 700 proceeds to 762.

At 762, method 700 estimates an amount of time it will take to move the engine's compression ratio from its present value to the forecast engine compression ratio at the predetermined time in the future. In one example, a function describing movement of the engine compression ratio is referenced by the change in the engine compression ratio from its present value to its forecasted value. The operation may be described as amount of time to change engine compression ratio=CR_time (CR_Δ), where CR_time is a function that outputs an amount of time to change the engine compression ratio and CR_Δ is the change in compression ratio (e.g., 2:1). The values in the function CR_time may be determined via operating the engine, demanding a compression ratio change, and recording an amount of time it takes for the compression ratio changing device to change the engine's compression ratio from its initial value to its demanded value. Method 700 proceeds to 763 after the time to change the engine's compression ratio is estimated.

At 763, method 700 begins to change the engine's compression ratio from its present value to the forecasted value when the amount of time to the beginning of the forecasted transmission shift is equal to the time it takes to move the engine compression ratio from its present value to the forecasted engine compression ratio (e.g., the engine compression ratio based on engine speed and load immediately following the downshift) plus a threshold amount of time. Thus, if the transmission is forecast to shift 2 seconds in the future from the present time, it takes 0.5 seconds to change the engine compression ratio, and the threshold amount of time is 0.1 seconds, then the compression ratio begins to change to the forecast value 1.4 seconds in the future. The compression ratio change is completed before the transmission downshifts to reduce the possibility of engine knock. Method 700 proceeds to 764.

At 764, method 700 shifts the transmission to the forecasted or new gear when the engine speed and accelerator pedal position intersect a shift curve in the transmission shift schedule. Method 700 proceeds to exit after downshifting the transmission.

At 770, method 700 judges whether or not engine load is less than a threshold engine load. If so, the answer is yes and method 700 proceeds to 771. Otherwise, method 700 proceeds to 780.

At 771, method 700 prevents the engine compression ratio from changing beginning a predetermined amount of time before the forecast transmission gear shift. For example, if the forecast transmission gear shift is in 2 seconds, the engine compression ratio may not be adjusted within 0.5 seconds of the forecasted transmission gear shift. This may reduce the possibility of driveline torque disturbances during the gear shift. Method 700 proceeds to 772.

At 772, method 700 shifts the transmission to the forecasted or new gear when the engine speed and accelerator pedal position intersect a shift curve in the transmission shift schedule. Method 700 proceeds to 773 after upshifting the transmission.

At 773, method 700 begins to change the engine's compression ratio from its present value based on the present engine speed and engine load after the forecasted transmission upshift. Method 700 proceeds to exit after adjusting the engine compression ratio.

At 780, method 700 estimates what the engine load and engine speed will be immediately following the forecasted upshift. In one example, method 700 estimates the engine speed immediately following the forecasted upshift by dividing the vehicle speed that is forecasted immediately following the upshift (e.g., the vehicle speed forecast at 720) by the combined ratio of the forecasted gear and the vehicle's axle. The result is then divided by the distance the tire travels in a single rotation. The forecast engine load may be determined via converting accelerator pedal position into an engine torque via a function of accelerator pedal position and vehicle speed at the predetermined time in the future. Once the forecast engine torque is determined, forecast engine load may be determined via a function or table that describes forecast engine load as a function of forecast engine speed and forecast engine torque. Method 700 proceeds to 781 after determining the forecasted engine speed and load values.

At 781, method 700 determines forecast engine compression ratio at the predetermined time in the future. The forecast engine compression ratio is based on the forecast engine load and speed that were determined at 780. In one example, the forecast engine load and speed are applied as indexes or reference values into an engine compression ratio map (e.g., as shown in FIG. 5) and the engine compression ratio map outputs an engine compression ratio value. Method 700 proceeds to 782.

At 782, method 700 estimates an amount of time it will take to move the engine's compression ratio from its present value to the forecast engine compression ratio at the predetermined time in the future. In one example, a function describing movement of the engine compression ratio is referenced by the change in the engine compression ratio from its present value to its forecasted value. The operation may be described as amount of time to change engine compression ratio=CR_time (CR_Δ), where CR_time is a function that outputs an amount of time to change the engine compression ratio and CR_Δ is the change in compression ratio (e.g., 2:1). The values in the function CR_time may be determined via operating the engine, demanding a compression ratio change, and recording an amount of time it takes for the compression ratio changing device to change the engine's compression ratio from its initial value to its demanded value. Method 700 proceeds to 783 after the time to change the engine's compression ratio is estimated.

At 783, method 700 begins to change the engine's compression ratio from its present value to the forecasted value when the amount of time to the beginning of the forecasted transmission shift is equal to the time it takes to move the engine compression ratio from its present value to the forecasted engine compression ratio (e.g., the engine compression ratio based on engine speed and load immediately following the upshift) plus a threshold amount of time. Thus, if the transmission is forecast to shift 2 seconds in the future from the present time, it takes 0.5 seconds to change the engine compression ratio, and the threshold amount of time is 0.1 seconds, then the compression ratio begins to change to the forecast value 1.4 seconds in the future. The compression ratio change is completed before the transmission downshifts to reduce the possibility of engine knock. Method 700 proceeds to 784.

At 784, method 700 shifts the transmission to the forecasted or new gear when the engine speed and accelerator pedal position intersect a shift curve in the transmission shift schedule. Method 700 proceeds to exit after upshifting the transmission.

In this way, the compression ratio may be changed immediately before a gear shift to reduce the possibility of engine knock immediately following the gear shift. Further, during conditions where the engine compression ratio is low before a gear shift, the compression ratio may not be changed until immediately following the gear shift so that the possibility of driveline torque disturbances during the transmission gear shift may be avoided.

Thus, the method of FIGS. 7-11 provides for an engine operating method, comprising: adjusting an engine's compression ratio via a controller responsive to present engine speed and engine load; forecasting a shifting of a transmission from a first gear to a second gear via the controller; and adjusting an engine's compression ratio via the controller responsive to an engine speed and engine load based on the forecasted shifting of the transmission. The method includes where the engine's compression ratio is adjusted before the shifting of the transmission from the first gear to the second gear. The method includes where adjusting the engine's compression ratio before the shifting of the transmission from the first gear to the second gear includes beginning to change the engine's compression ratio beginning at a time before the shifting of the transmission from the first gear to the second gear begins, the time being a time the shifting of the transmission from the first gear to the second gear begins minus a time for a compression ratio changing actuator to change the engine from its present compression ratio to a compression ratio based on engine speed and engine load after shifting the transmission from the first gear to the second gear. The method includes where the first gear is a higher gear than the second gear so that the shifting of the transmission from the first gear to the second gear is a downshift. The method includes where the first gear is a lower gear than the second gear so that the shifting of the transmission from the first gear to the second gear is an upshift. The method further comprises delaying adjusting of the engine's compression ratio to a time immediately following the shifting of the transmission from the first gear to the second gear.

The method also provides for an engine operating method, comprising: adjusting an engine's compression ratio via a controller responsive to present engine speed and engine load; forecasting a shifting of a transmission from a first gear to a second gear while an accelerator pedal is being released or immediately after the accelerator pedal is released via the controller; and maintaining an engine's compression ratio from a time when the shifting of the transmission from the first gear to the second gear begins to a time when shifting of the transmission from the first gear to the second gear ends via the controller. The method includes where the time when the shifting of the transmission from the first gear to the second gear begins is a time when an on-coming clutch begins to be applied. The method includes where the time when the shifting of the transmission from the first gear to the second gear ends is a time when an on-coming clutch is fully applied. The method further comprises changing the engine's compression ratio immediately following shifting of the transmission from the first gear to the second gear. The method includes where the first gear is a higher gear than the second gear so that the shifting of the transmission from the first gear to the second gear is a downshift. The method includes where the first gear is a lower gear than the second gear so that the shifting of the transmission from the first gear to the second gear is an upshift. The method further comprises shifting the transmission from the first gear to the second gear when engine speed and engine load equal engine speed and engine load of a transmission shift schedule curve. The method includes where forecasting shifting of the transmission includes anticipating an engine accelerator pedal position and anticipating a vehicle speed.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, at least a portion of the described actions, operations and/or functions may graphically represent code to be programmed into non-transitory memory of the computer readable storage medium in the control system. The control actions may also transform the operating state of one or more sensors or actuators in the physical world when the described actions are carried out by executing the instructions in a system including the various engine hardware components in combination with one or more controllers.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. An engine operating method, comprising:

adjusting an engine's compression ratio via a controller responsive to present engine speed and engine load;

forecasting a shifting of a transmission from a first gear to a second gear via the controller; and adjusting an engine's compression ratio via the controller responsive to an engine speed and engine load based on the forecasted shifting of the transmission.

2. The method of claim 1, where the engine's compression ratio is adjusted before the shifting of the transmission from the first gear to the second gear.

3. The method of claim 2, where adjusting the engine's compression ratio before the shifting of the transmission from the first gear to the second gear includes beginning to change the engine's compression ratio beginning at a time before the shifting of the transmission from the first gear to the second gear begins, the time being a time the shifting of the transmission from the first gear to the second gear begins minus a time for a compression ratio changing actuator to change the engine from its present compression ratio to a compression ratio based on engine speed and engine load after shifting the transmission from the first gear to the second gear.

4. The method of claim 1, where the first gear is a higher gear than the second gear so that the shifting of the transmission from the first gear to the second gear is a downshift.

5. The method of claim 1, where the first gear is a lower gear than the second gear so that the shifting of the transmission from the first gear to the second gear is an upshift.

6. The method of claim 5, further comprising delaying adjusting of the engine's compression ratio to a time immediately following the shifting of the transmission from the first gear to the second gear.

7. An engine operating method, comprising:

adjusting an engine's compression ratio via a controller responsive to present engine speed and engine load;

forecasting a shifting of a transmission from a first gear to a second gear while an accelerator pedal is being released or immediately after the accelerator pedal is released via the controller; and maintaining an engine's compression ratio from a time when the shifting of the transmission from the first gear to the second gear begins to a time when shifting of the transmission from the first gear to the second gear ends via the controller.

8. The method of claim 7, where the time when the shifting of the transmission from the first gear to the second gear begins is a time when an on-coming clutch begins to be applied.

9. The method of claim 7, where the time when the shifting of the transmission from the first gear to the second gear ends is a time when an on-coming clutch is fully applied.

10. The method of claim 7, further comprising changing the engine's compression ratio immediately following shifting of the transmission from the first gear to the second gear.

11. The method of claim 10, where the first gear is a higher gear than the second gear so that the shifting of the transmission from the first gear to the second gear is a downshift.

12. The method of claim 7, where the first gear is a lower gear than the second gear so that the shifting of the transmission from the first gear to the second gear is an upshift.

13. The method of claim 7, further comprising shifting the transmission from the first gear to the second gear when engine speed and engine load equal engine speed and engine load of a transmission shift schedule curve.

14. The method of claim 7, where forecasting shifting of the transmission includes anticipating an engine accelerator pedal position and anticipating a vehicle speed.

15. A vehicle system, comprising:

an engine including a compression ratio adjustment linkage;

an automatic transmission coupled to the engine; and a controller including executable instructions stored in non-transitory memory to change the engine's compression ratio via the compression ratio adjustment linkage according to an increasing or decreasing accelerator pedal position and a forecast gear shifting of the automatic transmission from a first gear to a second gear.

16. The system of claim 15, further comprising additional instructions to change the engine's compression ratio before shifting the automatic transmission from the first gear to the second gear.

17. The system of claim 16, where changing the engine's compression ratio includes decreasing the engine's compression ratio.

18. The system of claim 15, further comprising additional instructions to change the engine's compression ratio immediately after shifting the automatic transmission from the first gear to the second gear.

19. The system of claim 18, where changing the engine's compression ratio includes increasing the engine's compression ratio.

20. The system of claim 15, where forecasting the shifting of the transmission includes anticipating an accelerator pedal position and anticipating a vehicle speed.

* * * * *